United States Patent [19]

Easter

[11] Patent Number: 4,865,191

[45] Date of Patent: Sep. 12, 1989

[54] PROTECTIVE COVER FOR OPTICAL INSTRUMENTS DURING FIELD USE

[76] Inventor: Michael D. Easter, 840 J St., Penrose, Colo. 81240

[21] Appl. No.: 155,232

[22] Filed: Feb. 12, 1988

[51] Int. Cl.[4] ..... B65D 65/08; A45C 11/08

[52] U.S. Cl. ..... 206/315.3; 224/909; 350/582; 350/587

[58] Field of Search ..... 150/52 R, 52 J; 206/316; 350/581, 585, 586; 224/909

[56] References Cited

U.S. PATENT DOCUMENTS

| | | | |
|---|---|---|---|
| 2,499,451 | 12/1949 | Magid | 150/52 B X |
| 2,599,689 | 6/1952 | Breisford | 350/587 X |
| 2,813,564 | 11/1957 | Benz | 150/52 J |
| 3,528,720 | 9/1970 | Treace | 206/316 X |
| 4,176,706 | 12/1979 | Welgan | 150/52 J |
| 4,232,808 | 11/1980 | Gray | 224/909 X |
| 4,557,451 | 12/1985 | Conway | 206/316 X |
| 4,751,950 | 6/1988 | Bock | 206/316 X |

*Primary Examiner*—Sue A. Weaver
*Attorney, Agent, or Firm*—Klaas and Law

[57] ABSTRACT

A protective covering device for telescopic optical instruments that are being used in the field, comprises a single expanse of flexible waterproof material (4) having sufficient size to envelope the lenses and lense housing tubes on a telescopic instrument (20). Attached to the fabric (4) edge is a length of elastic (6) member running along the entire perimeter, except for the length of a skirt (12) whereby the elastic member divides the skirt from the rest of the cover (18). Attached to the elastic edge directly across from the skirt are two loops (14) provided for holding attachment straps (10A and 10B). The attachment straps are elastic with a coating of silicone rubber (16) on one side and means for releasably connecting the strap ends together are provided by hook and loop material (8), whereby the straps can be pulled around circumferentially and hooked to the objective end of optical instrument.

As the covering device (18) is pulled up and over the instrument by the skirt, the integral elastic member is stretched into tension, providing a retaining and sealing of the flexible material about the lenses and body of the optical instrument.

7 Claims, 2 Drawing Sheets

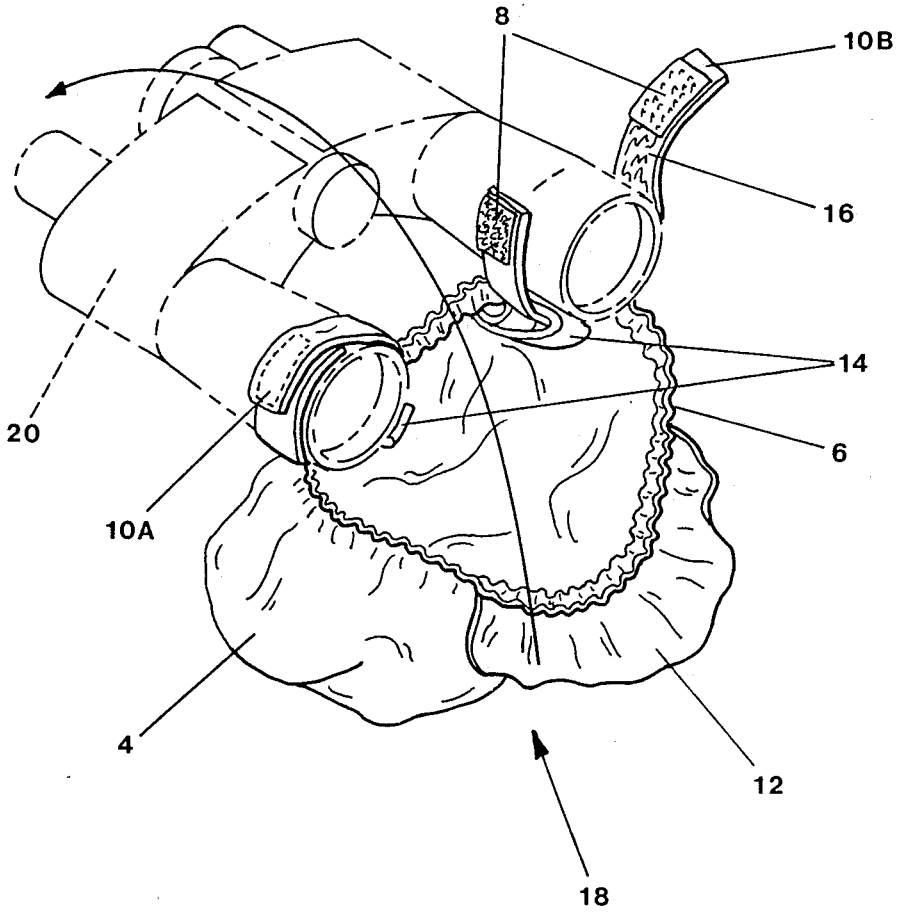
8
10B
16
14
6
20
10A
4
12
18
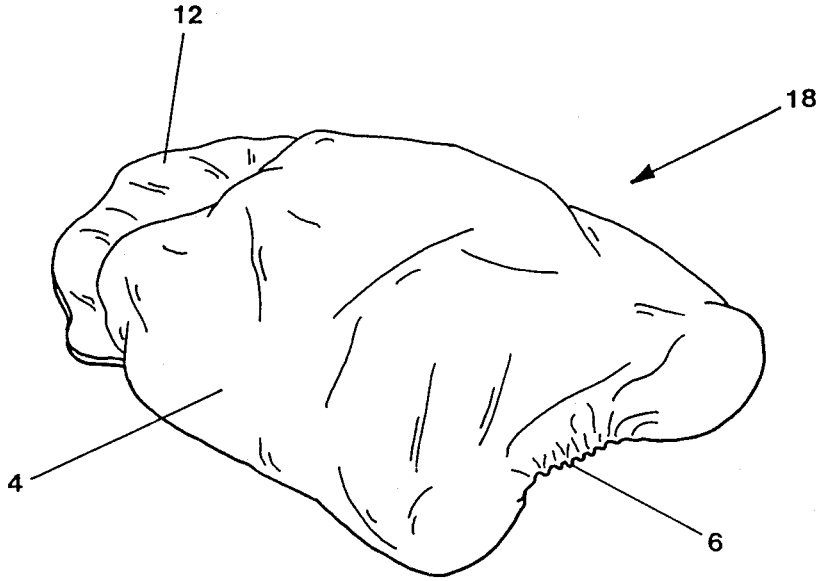
12
18
4
6

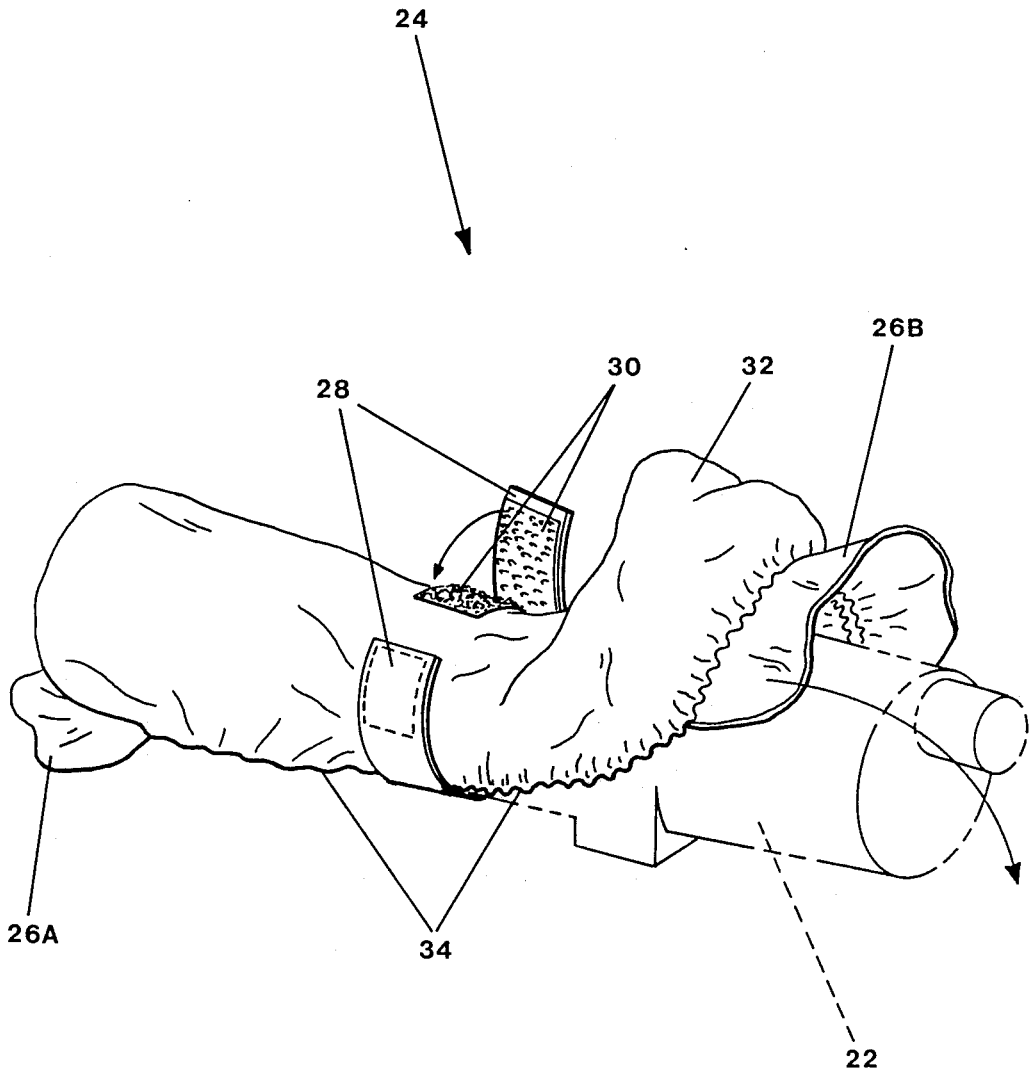
24
26B
30
32
28
26A
34
22

PROTECTIVE COVER FOR OPTICAL INSTRUMENTS DURING FIELD USE

BACKGROUND FIELD OF INVENTION

This invention relates to a protective covering device for optical instruments and more particularly to a new, attached, pullover cover providing protection for optical instruments with telescopic lenses while being used in the field.

1. Background Cross Reference To Related Applications

I have filed a related application with the U.S. Pat. Office as of 11 Jan. 1988 with a filing number of 142193.

2. Background Description Of Prior Art

Heretofore protective coverings for optical instruments with telescopic lenses have taken various forms with some providing complete protection, to include padding, while others provide protection for the lenses along. The types providing complete protection are designed for carrying the instrument to and from the field or for storing the instrument. These cases, as they are called, can be zippered fabric containers, but many are hard sided, being closed with mechanical latches and all handles or straps for carrying purposes. Another feature of many of these cases are extra compartments for attachments and accessories.

Another case, designed to be used with binoculars while in the field, attaches to the waistbelt of the user or hangs by a strap from the neck of the user and holds the binoculars in a rectangular box having a closing flap on the top. While this case provides adequate protection, it also poses the problems of being difficult, if not impossible, to use when the user is wearing heavy winter gloves, and if the user's hands are cold or wet there is the real possibility of dropping the binoculars on the ground or rocks as there would be no straps attached to the binoculars with this type of case. This case is also limited to use use on binoculars only. Still another protective covering, U.S. Pat. No. 2,372,479 by French is composed of a rubber sheathing adhering tightly about the tube of optical instruments provides protection from bumping and droppage while leaving the lenses and focus adjust knob exposed to rain, snow, dust and twigs. The French cover is not interchangeable between different sized instruments.

OBJECTS AND ADVANTAGES

It has long been felt that protection was needed for telescopic instruments while being used in the field as is evidenced by the array of lense caps both attachable and not, and also the rubber coverings fro the tubes of the instruments. Heretofore a full protective covering designed for quick and easy use in the field, while remaining conventiently attached to the instrument has not been available.

Therefore there exists a need for a cover that provides protection for telescopic optical instruments such as binoculars, spotting scopes, telescopes, cameras with telephoto lenses and surveyors' transits. The cover should protect the lenses, tube, adjust knobs, and any attachments, such as a camera, while the instrument is being used in the field. Such a cover should provide protection against rain, snow, dust, twigs and the like. Moreover, the cover should be quick and easy to open allowing use of the instrument while remining attached to the instrument, thereby preventing loss or droppage of the cover. A still further object is that the cover be easily opened or closed by a persom wearing heavy winter gloves. It is desirable that the cover be self sealing and self adjusting with a minimum amount of effort.

Another somewhat unexpected feature would be the use of one cover on different sized instruments. The additional features of easy attachment and detachment to and from the instrument are also objectives. Then a still further object would be cover that could be folded and conventiently carried in a clothing pocket when not needed on the instrument. Yet other objectives of the invention would be to provide a cover that is lightweight, durable, inexpensive and attractive. Another feature desired is that it be quiet to open and close, a necessity when observing birds or other wildlife.

Other objects and advantages of my invention will become apparent from the following description and the accompanying drawings.

DESCRIPTION OF THE DRAWINGS

FIG. 1 is a pictorial view of my invention showing the cover in the open position.

FIG. 2 is a pictorial view showing the cover in the closed position.

FIG. 3 shows a pictorial view of the protective cover embodiment for a single tubed instrument (spotting scope pictured).

DRAWING REFERENCE NUMERALS

4 fabric of cover
6 elastic
8 hook & loop fastener
10A and 10B attachment straps
12 skirt
14 loops
16 rubbery coating
18 binocular cover
20 double tubed optical instrument (binocular)
22 single tubed optical instrument (monocular)
24 monocular cover
26A and 26B skirts of monocular cover
28 attachment strap on monocular cover
30 hook & loop fastener
32 fabric of 24
34 elastic edge on 32

DESCRIPTION OF THE INVENTION

As illustrated in FIG. 1, the covering device 18 consists of a single expanse of flexible fabric 4, perferably nylon with a urethane coating for waterproofing. However, any textile material having properties which result in a flexible waterproof fabric could be used.

The cover 18 as shown in FIG. 1 has the appearance of an open bag characterized by a single length of elastic 6 member being sewn directly to the fabric 4 or fed through a casing attached to the fabric 4. The elastic 6 is integrally attached to the entire edge of the cover 18 except for the length of a fabric skirt 12 whereby the elastic 6 runs between the skirt 12 and the main body of the cover 18. The relaxed length of the elastic 6 is less than the original extended length of the fabric edge, thereby causing a gathering and puckering of the fabric edge when the elastic is attached. The elastic 6 runs along the cover 18 edge for approximately $\frac{3}{4}$ the opening perimeter, then moving inward from the edge the remaining $\frac{1}{4}$ distance creating the fabric skirt 12. Also adjacent to the elastic edge 6 and directly across from the skirt 12 are two fabric loops 14 attached to the fabric 4 and looping inward at 90 degrees from the elastic 6 edge. The loops 14 are spaced a sufficient distance apart to allow subsequent attachment to the binocular 20 tubes. Attachment straps 10A and 10B are comprised of elastic strap with a rubbery coating 16 on one side and a releasable connector device 8 towards the ends. The rubbery coating 16 is accomplished by applying a thin layer of liquid silicone rubber and allowed to dry. It should also be noted that one skilled in the art might use a variety of other types of attachment straps to include a simple rubber band or a coated spring steel band or a springable band made of plastic. The releasable connector device 8 is hood and loop material sewn to the elastic strap. One skilled in the art might use a variety of other releasable connector devices to include snaps and hooks.

OPERATION OF INVENTION

From the above description of the cover 18, is should be apparent that it becomes a simple procedure to use the cover 18 on binocular instruments in the field.

To attach the cover to a pair of binoculars 20, the user would position the cover 18 adjacent to the objective end of the binoculars 20, having the two attachment straps 10A and 10B positioned close to the binocular tubes while keeping the skirted 12 edge the most distant from the binoculars 20. Now wrap the attachment straps 10A and 10B around their respective tube ends keeping the rubber coated surface 16 inward while stretching the strap 10A and 10B and then pressing the hook and loop faces 8 together.

The novel combination of elastic, coated with tacky rubber 16, produces an attachment strap 10A and 10B of exceptional grip and stability even on slick metal surfaces. The binoculars 20 can now be freely used while the protective cover 18 hangs conveniently out of the way beneath the binoculars 20.

Covering the binoculars 20 is easily accomplished by graping the skirt 12 and pulling it up and over the binoculars 20 thereby stretching the elastic 6 edge and enclosing the binoculars 20 to include both the objective lenses and the ocular lenses as shown in FIG. 2. It should be noted here that the various methods of attaching neckstraps to binoculars are accommodated by the protective cover 18, even those attaching on the sides of the binocular 20 tubes, as the elastic 6 edge simply stretches over and around such attachment points.

Monocular Cover

FIG. 3 shows a protective covering device according to another configuration of the invention. Users can use this cover to protect single tubed instruments with equal convenience and efficiency as the binocular covering divece of FIG. 1. The protective cover comprises a single elongated expanse of flexibel waterproof fabric 32 characterized by a single length of elastic 34 member being sewn directly to the fabric 32 or fed through a casing attached to the fabric 32. The elastic 34 runs along the cover 24 edge for the total opening perimeter, excepting the skirted ends 24A and 26B wherein the elastic 34 defines a boundary between the skirts 26A and 26B and the rest of the cover 24. Skirts 26A and 26B are positioned at opposite ends of the elongated cover 24, and are comprised of sufficient fabric to be easily grasped by a person wearing heavy winter gloves. An attachment strap 28 is comprised of the same materials as attachment straps 10A and 10B of FIG. 1, except the loop portion of the hook and loop fastener 30 is attached to the cover fabric 32 rather than the strap. The attachment strap 28 has one end permanently attached to the cover material 32, while the other end has a portion of hoek and loop fastening material 30 attached to it. Attachment strap 28 lays perpendicular to the linear shape of the cover 24 and has sufficient length to be wrapped around the midsection of the instrument 22 tube and be connected to a mating portion of hook and loop fastener 30 attached to the cover fabric 32.

In operation, the cover 24 would be placed on the instrument 22 by pulling the skirted ends 26A and 26B over their respective ends of the instrument 22, thereby causing a sealing and holding of the cover about the instrument as the elastic edge is pulled into tension. Next, wrap the attachment strap 28 around the instrument 22, stretching the strap sufficiently to allow adequate mating of the hook and loop material 30.

Viewing through the instrument is now easily accomplished by simply lifting the skirted ends 26A and 26B up over their respective ends on the insrument 22 and releasing them to rest on top of the instrument 22. At this point the elastic edge 34 is in a relaxed and constricted state, keeping the skirted ends 26A and 26B from interfering with instrument use, yet, still providing some protection for the midportion of the instrument 22 tube. While the cover 24 is in this opened and relaxed position, the attachment strap 28 holds the cover securely to the instrument 22, even when wind is blowing. On a telescopic instrument having a longer lense tube, two or more attachment straps 28 may be employed at spaced distances along the tube.

An additional unexpected feature is the freedom to attach a tripod or other supporting device to the instrument 22 while also using the protective cover. Furthermore, it isn't necessary to remove the protective cover 24 when the instrument 22 is placed in a traditional carrying case.

While the above description contains many specifications, the reader should not construe these as limitations on the scope of the invention, but merely as exemplifications of preferred embodiments thereof. These skilled in the art will envision that many other possible variations are within it's scope. For example, skilled artisans will readily be able to change the dimensions and shapes of the various embodiments. The loops in FIG. 1 might be replaced by making slits in the cover fabric, thereby providing another means for the attachment straps to be connected to the cover fabric. Accordingly, the reader is requested to determine the scope of the invention by the appended claims and their legal equivalents, and not by the examples which have been given.

I claim:

1. A protective covering device for telescopic optical instruments during field use comprising:

a single expanse of flexibel water resistant cover material having sufficient size to cover the body and lenses of an instrument when said instrument is in a normal position of use;

releasable attachment means mounted on the cover material for attaching the cover material to the instrument and comprising an elastic strap that circumferentially constricts on the lens tube of an optical instrument;

elastic means for retaining and sealing of said flexible material the body of an instrument when said covering device is in the closed porition; and said releasable attachment means comprising hook and loop fastener material attached to the ends of said elastic strap.

2. The covering device of claim 1, wherein said elastic strap has at least one surface coated with silicone rubber thereby providing a slip resistant surface.

3. The covering device of claim 1 wherein said retaining and sealing means is comprised of a single elastic member attached to said flexible material.

4. The covering device of claim 3, wherein said elastic member is a single elastic strip integrally attached to the entire edge of said cover except for the length of a fabric skirt whereby said elastic strip runs between said skirt and the main body of said cover.

5. The covering device of claim 4 whereby said elastic member is stretched when said covering device is in the closed position and relaxed and shorter when said covering device is in the open position.

6. A protective covering device for telescopic optical instruments during field use comprising:

a single expanse of water resistant flexible cover material having sufficient size to cover the body and lenses of an instrument when said instrument is in a normal position of use;

releasable attachment means mounted on the cover material for attaching the cover material to the instrument and comprising a strap that circumferentially constricts on the lens tube of an optical instrument;

elastic means for retaining and sealing of said flexible cover material about the body of an instrument when said covering device is in the closed position; and said elastic means comprises a single elastic strip integrally attached to the entire edge of said flexible cover material except for the length of a fabric skirt whereby said elastic strip runs between said skirt and the main body of said cover material.

7. The covering device of claim 6 whereby said elastic strip is stretched when said covering device is in the closed position and relaxed and shorter when said covering device is in the open position.

* * * * *